US005465942A

United States Patent [19]

Wells et al.

[11] Patent Number: 5,465,942

[45] Date of Patent: Nov. 14, 1995

[54] TUYERE ARRANGEMENT FOR THE INTRODUCTION OF AGENTS INTO A MOLTEN BATH AND METHOD OF OPERATING SUCH A TUYERE ARRANGEMENT

[75] Inventors: William Wells, Devon, England; Georg Raidl, Vienna; Walter Schmelzer, Langenzersdorf, both of Austria

[73] Assignee: Kortec AG, Zug, Switzerland

[21] Appl. No.: 87,728

[22] PCT Filed: Nov. 3, 1992

[86] PCT No.: PCT/EP92/02520

§ 371 Date: Mar. 2, 1994

§ 102(e) Date: Mar. 2, 1994

[87] PCT Pub. No.: WO93/09255

PCT Pub. Date: May 13, 1993

[30] Foreign Application Priority Data

Nov. 6, 1991 [DE] Germany ..... 41 36 552.6

[51] Int. Cl.[6] ..... C21B 7/10; C21B 7/16

[52] U.S. Cl. ..... 266/46; 266/47; 266/222; 266/268; 266/270

[58] Field of Search ..... 266/46, 47, 218, 266/222, 266, 268, 270

[56] References Cited

U.S. PATENT DOCUMENTS

| | | | |
|---|---|---|---|
| 3,829,073 | 8/1974 | Courad . | |
| 4,023,781 | 5/1977 | Fritz et al. | 266/222 |
| 4,331,471 | 5/1982 | Langenfeld et al. | 266/217 |
| 4,434,976 | 3/1984 | Murakami et al. | 266/268 |
| 4,449,701 | 5/1984 | Pitzer et al. | 266/218 |
| 4,522,376 | 6/1985 | Langenfeld | 266/47 |

FOREIGN PATENT DOCUMENTS

| | | | |
|---|---|---|---|
| 2334751 | 10/1975 | France . | |
| 2629101 | 3/1988 | France . | |
| 2324086 | 5/1973 | Germany . | |
| 2455029 | 11/1974 | Germany . | |
| 3318422 | 5/1983 | Germany . | |
| 391483 | 12/1986 | Germany . | |
| 3907887 | 3/1988 | Germany . | |
| 3809828 | 3/1988 | Germany . | |
| 3833502 | 10/1988 | Germany . | |
| 3904356 | 2/1989 | Germany . | |
| 1208411 | 8/1989 | Japan | 266/47 |
| 1152330 | 11/1966 | United Kingdom . | |
| 2140142A | 11/1984 | United Kingdom . | |

*Primary Examiner*—Melvyn J. Andrews
*Attorney, Agent, or Firm*—Lahive & Cockfield

[57] ABSTRACT

To increase the service life of a tuyere arrangement for the introduction of agents into a molten bath, comprising an apertured block (3) refractory material which can be fitted into the wall (1) of a vessel (12) and which includes a cylindrical body (4) with an inserted tuyere tube (6,7), the cylindrical (4) is axially displaceably fitted in the apertured block (3) the tuyere tip which is consumed is replaced by a follow-up movement of the cylindrical body (4).

18 Claims, 2 Drawing Sheets

TUYERE ARRANGEMENT FOR THE INTRODUCTION OF AGENTS INTO A MOLTEN BATH AND METHOD OF OPERATING SUCH A TUYERE ARRANGEMENT

BACKGROUND OF INVENTION

The invention concerns a tuyere arrangement for the introduction of agents into a molten bath. The invention further concerns a method of operating such a tuyere arrangement.

German Publication No. DE-C2-38 09 828 discloses a tuyere arrangement of that kind. The known arrangement for the introduction of gases and/or solid reagents and additives into a metallurgical smelting vessel includes an apertured block or brick which is fitted into the wall of the vessel and which axially slidably accommodates a scavenging or flushing block having at least one gas duct which can be connected to a gas conduit. The outlet opening of the gas duct is provided at the peripheral surface of the scavenging or flushing block so that the outlet opening is exposed and the agents can be introduced into the molten bath only when the scavenging or flushing block has been advanced with its inner end beyond the annular end face of the apertured block. Withdrawal of the scavenging or flushing block guarantees a closure effect, without the necessity of applying a continuous gas pressure to the scavenging or flushing system, so that the tuyere arrangement is particularly suitable for transportation vessels such as a ladle, in regard to which it is not possible for the gas scavenging or flushing system to be supplied with gas over the entire residence time of the molten material in the vessel. Accordingly axial displacement of the scavenging or flushing block serves to provide that it can be used not only for the introduction of agents but also as a closure member.

German Publication No. DE-C-23 24 086 discloses a tuyere for the introduction of refining gas, in particular oxygen, through the wall of a refining vessel, beneath the surface of the bath, wherein the refining gas is passed into the molten bath through an inner tube and a protective agent is passed into the molten bath through a concentric outer tube, and the two tubes are arranged concentrically in a stationary casing tube. The inner and the outer tubes are axially displaceable and interchangeably arranged at respective spacings in at least one casing tube.

That arrangement provides at least one additional annular space for the introduction of a protective agent and it affords the possibility of changing or axially displacing the inner and the outer tubes between two batches in order to deal with brickwork wear in the immediate vicinity of the tuyeres. Thus, in the case of a funnel-like configuration being formed by wear in the region of the outlet opening of the tuyere arrangement, the inner and outer tubes can be advanced and then the funnel configuration can be filled up for example by spraying or plugging.

European patent publication No. EP-B1-0 182 965 discloses a method of protecting a tuyere comprising at least three concentric tubes forming a central duct and at least two annular ducts, wherein an oxygen-bearing gas is injected through the central duct and a mist of atomised water is injected as a cooling fluid through an annular duct, atomisation of the water being effected by means of a carrier gas in a tuyere head at the entry side of the tuyere. That cooling fluid has proven to be particularly effective in regard to an increase in the service life of the tuyere.

In a tuyere arrangement for the introduction of agents into a molten bath, the object of the present invention is that of increasing the service life, reducing the down times and simplifying maintenance operations. The invention further seeks to provide a method of operating that tuyere arrangement.

SUMMARY OF THE INVENTION

In the tuyere arrangement according to the invention, both the tip of the tuyere tubes, which is being consumed, and also the refractory material which surrounds that tip, is either continuously or periodically replaced by a follow-up movement of the sleeve containing the metal tuyere tube or tubes. As the tuyere is intended for use beneath the surface of the molten bath, besides axially displaceability of the sleeve, it is also necessary to ensure that no molten material can pass into the annular gap between the surfaces which are to be displaced relative to each other. This is made possible by the fact that the sleeve is coated with a lubricant layer which can be thermally loaded, an annular gap is provided between the outside of the sleeve and the inside of the apertured block, and the annular gap is sealed off with a cement layer. In that way, with an axially slidable sleeve, it is possible to produce a durable sealing action between the sliding surfaces even for a low-viscosity molten material such as a molten lead bath at temperatures of about 1200° C. As the nozzle tip is exposed to temperatures of between 1000° and 2000° C., depending on the area of use, it is essential that not only the cement layer for sealing off the annular gap but also the lubricant layer which permits the axial sliding movement can withstand a thermal loading. In addition, the material of the lubricant layer should have only a very slight wetting tendency relative to the adjoining cement layer. In the case of a cement layer on a magnesite or chrome-magnesite base, graphite and molybdenum compounds have proven to be particularly advantageous as the material for the lubricant layer.

At the beginning of use of the tuyere arrangement, the sleeve projects by a substantial portion at the outside of the apertured block. The follow-up inward movement of the sleeve which accommodates the metal tuyere tube, together with the tuyere tube, resulted in problems, namely damage to the sleeve, because of the differing bending elasticity of the metal and the ceramic material, with the bending loading which occurs by virtue of the sleeve being pushed in. It has been found that the difficulties can be overcome if the metal tuyere tube is not fitted fixedly into the bore in the sleeve but is axially slidable. For that purpose the outside of the tuyere tube, which is adjacent the inside of the sleeve, is coated with a lubricant layer which can be subjected to a thermal loading, an annular gap is provided between said outside of the tuyere tube and the inside of the sleeve, and the gap is sealed off with a cement layer. That reduces the transmission of axial forces between the outside of the tuyere tube and the inside of the sleeve and decreases the risk of damage to the sleeve in the follow-up movement.

While the lubricant layers on the outside surface of the sleeve and on the outside surface of the outer tuyere tube respectively are applied prior to insertion either into the apertured block or into the sleeve, the cement layer for sealing off the respective annular gap is forced in after introduction of the sleeve into the apertured block or after introduction of the tuyere tube into the sleeve respectively. For that purpose, radial bores for forcing in cement are provided in the apertured block or in the sleeve respectively, approximately at the middle of their axial length.

Although the service life of the tuyere arrangement can already be substantially enhanced by the continuous or periodic replacement of the tuyere tip, a further increase in service life is possible if, besides the treatment agents such as oxygen, coal dust etc, a cooling fluid is also introduced. In that case, the reduction in temperature along the sliding surfaces between the apertured block and the sleeve or between the sleeve and the outer tuyere tube respectively also maintain mutual displaceability for a longer period of time.

In a tuyere arrangement having a tuyere tube which is fitted into the sleeve, the cooling fluid can be introduced, for example can be blown in, together with the treatment agent. It is particularly advantageous, more especially because it permits independent control of the cooling action, if a tuyere arrangement is used in which fitted into the sleeve are at least two concentric metal tuyere tubes forming a central duct and at least one annular duct surrounding the central duct, wherein the treatment agent is then introduced through one duct and the cooling fluid is introduced through another duct. A particularly effective cooling action is achieved if a mist of atomised water as cooling fluid is supplied to one duct, in particular the outer annular duct. Evaporation of the small droplets of water contained in the spray mist, within the duct, and dissociation upon being introduced into the molten bath produce an intensive cooling action both over the whole of the thermally loaded length of the sleeve and also at the tuyere tip , and that intensive cooling action, in conjunction with the inward follow-up movement of the sleeve, results in unexpectedly high service lives.

In order to reduce the loading of the end face of the apertured block, which is towards the interior of the vessel, it is desirable for the sleeve always to be caused to project from the apertured block into the molten bath by a predetermined projection length, for example of the order of magnitude of 100 mm. The desired projection length can be maintained by inward follow-up movement of the sleeve.

The tuyere arrangement can be used in relation to different molten baths, in particular such as molten metal baths, molten iron baths and molten lead baths. It can also be adapted by virtue of its dimensions to the respective agents to be introduced which may be gaseous, liquid, pasty or dust.

BRIEF DESCRIPTION OF THE DRAWINGS

The invention is described in greater detail by means of two embodiments with reference to four Figures of drawings in which.

DETAILED DESCRIPTION

Figure 1:
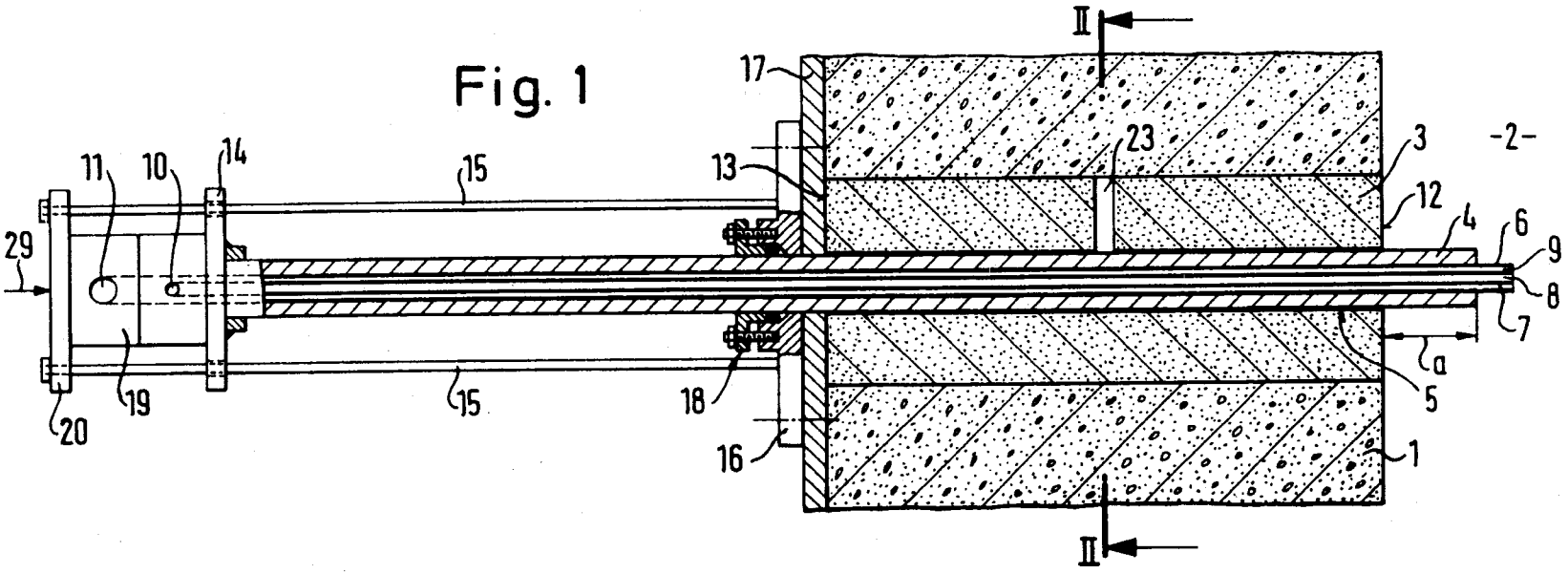
FIG. 1 is a view in longitudinal section through a first embodiment of a tuyere arrangement.
Figure 2:
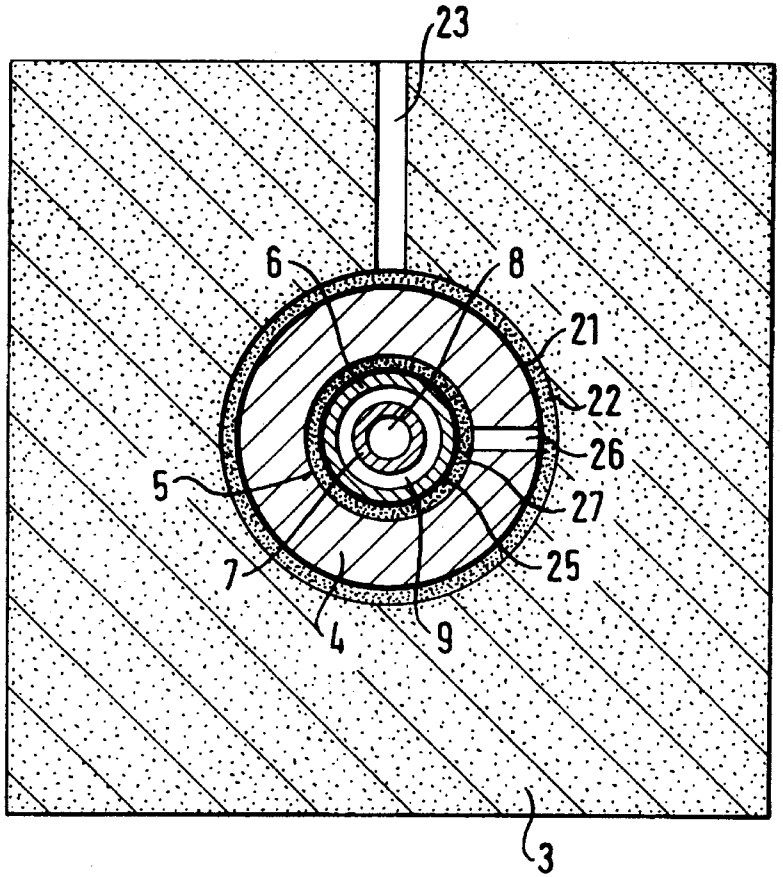
FIG. 2 is a view on an enlarged scale in section taken along line II—II in FIG. 1.

The tuyere arrangement illustrated in FIGS. 1 and 2 includes an apertured block 3 of refractory material which can be fitted into the wall 1 of a vessel 2. The wall of the vessel may be the bottom wall or the side wall of the vessel. The apertured block is to be inserted in such a way that the agent which is introduced through the tuyere arrangement is supplied to the molten bath beneath the level of the surface thereof.

The apertured block 3 axially slidably accommodates a sleeve 4 of a refractory material, which has an axial bore 5. Two concentric metal tuyere tubes 6 and 7 are fitted at a spacing from each other into the axial bore 5. The tuyere tubes 6 and 7 form a central duct 8 and an annular duct 9 which is disposed around the central duct. At the outer ends of the tuyere tubes those ducts are connected to connections 10 and 11 for the agents to be introduced. The sleeve 4, including the tuyere tubes 6 and 7, projects with its tuyere tip which faces into the interior of the vessel, that is to say with its inner end, beyond the inner end face 12 of the apertured block 3 by a projection length a, extends through the apertured block 3 and projects with its outer end from the outer end 13 of the apertured block 3 by a substantial distance which in the illustrated case approximately corresponds to the length of the apertured block 3. The outer end of the sleeve 4 is provided with a first pressure plate 14 which is guided by guide bars 15 which are fixed to the wall of the housing and which extend parallel to the sleeve 4. Reference numeral 16 identifies a flange which carries the guide bars 15 and which is fixed to the outer steel casing 17 of the furnace vessel 2. The flange 16 also carries a sealing arrangement 18.

The outer ends of the concentric tuyere tubes 6 and 7 are fixed in a tuyere head 19 which, at its outer end, has a second pressure plate 20 which is force-lockingly connected to the first pressure plate 14. The second pressure plate 20 is also guided by the guide bars 15.

As the enlarged view in FIG. 2 shows, the sleeve 4 is coated with a lubricant layer 21 and an annular gap between the outside of the sleeve 4 and the inside of the apertured block 3 is sealed off with a cement layer 22. The lubricant layer 21 is applied prior to insertion of the sleeve 4 into the apertured block 3. This may be for example a cover layer of slipping material such as a molybdenum compound, which is applied solid to the sleeve 4. The lubricant layer may also be applied to the sleeve 4 in the form of a film immediately prior to insertion of the sleeve 4. A radial bore 23 is provided in the apertured block 3 for the introduction of the sealing cement layer 22, the cement layer being forced in through the radial bore 23. The thickness of the annular gap which is to be filled up by the sealing cement layer must be so selected that the layer which is forced in by way of the radial bore 23 can penetrate as far as the end faces 12 and 13 of the apertured block 3. With the usual dimensions, a value of between 0.5 and 1 mm has been found appropriate as the thickness of the annular gap which is to be filled up by the cement layer.

The inner tuyere tube 7 is held by spacers (not shown) at a spacing within the outer tuyere tube 6, forming the annular gap 9. In this respect it is necessary to ensure that the spacers do not substantially impair the flow of agent through the annular duct 9.

The outer tube 6 is fitted into the sleeve 4 in such a way that a sealing closure action is produced between the outside of the outer tube and the inside of the sleeve, on the one hand, while on the other hand slight longitudinal movements between the sleeve and the outer tube are possible, that is to say, the transmission of axial forces at the interface between the sleeve and the outer tube is substantially avoided. For that purpose, a lubricant layer 25 is applied to the outer tube 6—that can be a solid coating which is applied in manufacture of the tube or a coating which is applied prior to insertion of the tube—and, after insertion of the tubes 6 and 7, a cement layer 27 is forced in, by way of at least one radial bore 26 in the sleeve 4, to seal off an annular gap between the outer tube 6 and the sleeve 4.

For treatment of a molten iron bath, the cement used is preferably a magnesite phosphate and, for treatment of a molten lead bath, the cement is preferably a chrome magnesite compound, while for treatment of molten glass the cement is preferably a magnesite silicon compound.

When using the tuyere arrangement for the under-bath injection of a treatment agent such as oxygen or coal dust into a steel bath, a conduit for the feed of oxygen gas or pulverised coal suspended in a carrier gas is connected to the connection 10 which is connected to the central duct 8 of the inner tuyere tube 7, while a conduit for the feed of a cooling fluid, preferably a mist of atomised water, is connected to the connection 11 which is connected to the annular duct 9. Atomisation of the water can also be effected by an atomisation device in the tuyere head 19, as is described for example in EP-182 965.

When, due to the thermal and mechanical loadings on the tuyere tip which projects into the molten bath, the tuyere tip has burnt back by a distance, the sleeve 4 together with the tuyere tubes 6 and 7 are pushed inwardly by a suitable distance and thus the consumed tuyere tip is replaced, by virtue of an axial force applied to the second pressure plate 20 (see arrow 29) and as a result of the force-locking connection between the first and second pressure plates 14 and 20. That operation can be effected at given time intervals, whereby the service life is substantially increased in comparison with a tuyere arrangement which does not have the option of such displacement. The fact that the sleeve and the aperture brick surrounding the sleeve are cooled by the cooling fluid which is passed through the outer annular duct 9, over the entire length of the sleeve, not only guarantees displaceability thereof over a longer period of time but also further enhances the service life of the tuyere arrangement. Service lives which are substantially increased in comparison with known tuyere arrangements can be achieved, while replacement of the consumed refractory material at the nozzle tip which is most heavily thermally and mechanically loaded can be effected by a follow-up inward movement of the sleeve 4, without interrupting the procedure for treating the molten bath.

Figure 3:
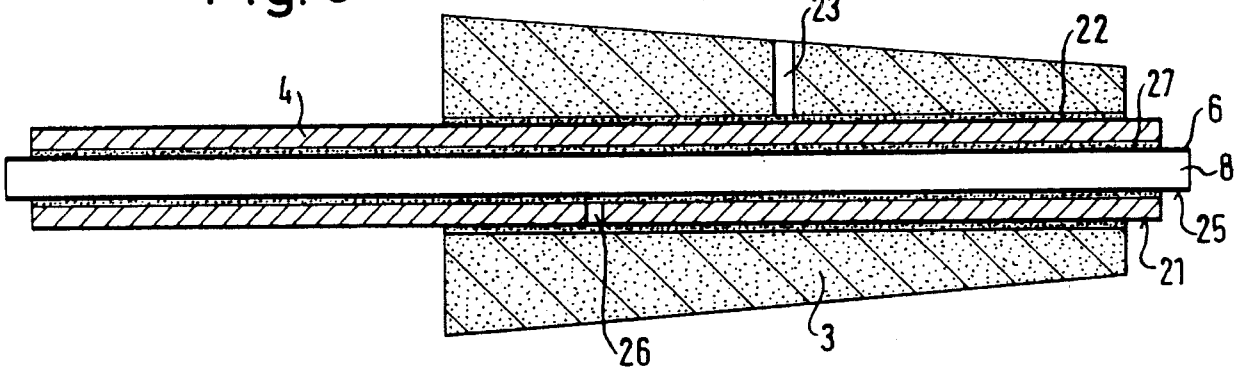
FIG. 3 is a view in longitudinal section through part of a further embodiment of a tuyere arrangement.
Figure 4:
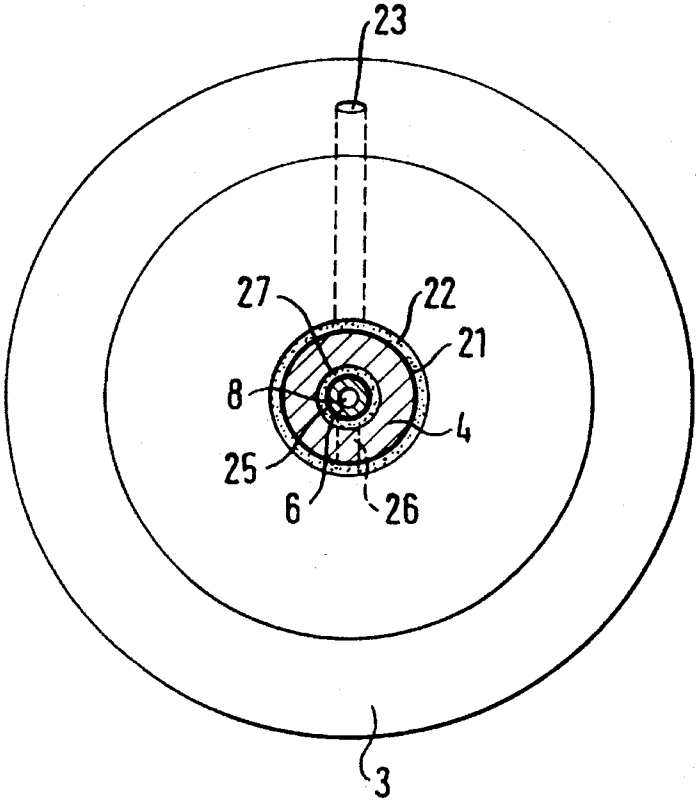
FIG. 4 is a side view from the right of the tuyere arrangement shown in FIG. 3.

The tuyere arrangement which is only partly shown in FIGS. 3 and 4 includes an apertured block 3 of conical configuration and only one tuyere tube 6. The same reference numerals have been used for components corresponding to those of the first tuyere arrangement as shown in FIGS. 1 and 2. Attention is directed to the description of those components in relation to the first embodiment.

The tuyere arrangement of the second embodiment was used for the oxidation of lead ores and for the reduction of lead oxide slag to form metal lead. The treatment process is subdivided into two parts, namely an oxidation part and a reduction part.

Slags with high proportions of iron oxide and lead oxide are produced in the oxidation part. The operating temperature is between 1000° and 1100° C. That is the part of the procedure which involves the greater degree of tuyere wear.

The reduction part involves operating temperatures of between 1200° and 1300° C., while the slag has a low proportion of lead oxide, namely about 2%, and contains about 20% iron oxide.

It has been found that chrome magnesite blocks have a longer service life than magnesite blocks. For that reason chrome magnesite is used both for the conical apertured block 3 and also for the sleeve 4. The treatment agent is introduced in each case through the central duct of the tuyere tube 6.

What is claimed is:

1. A tuyere arrangement for the introduction of agents into a molten bath and having a distal tip for facing into the interior of a vessel and a proximal end for facing outwardly from the vessel, comprising an apertured block of refractory material, which can be fitted into the wall of a vessel and which axially slidably accommodates a cylindrical body of a refractory material with an axial bore for introduction of the gas or the treatment agent, which cylindrical body has an outer end projecting out of the apertured block relative to said proximal tuyere end and at that outer end is provided with a first pressure plate for axial displacement of the cylindrical body, the cylindrical body surrounds a tuyere means having an outer metal tuyere tube and at least one inner metal tuyere tube concentrically spaced from said outer metal tuyere tube to form a central duct and a least one annular duct that surrounds said central duct and wherein the outer tuyere tube is axially slidably disposed in said cylindrical body and includes sealing means for forming a fluid seal between said, outer tuyere tube and said cylindrical body, and wherein said ducts are provided with an inlet for receiving an agent to be introduced.

2. A tuyere arrangement according to claim 1 characterised in that the sleeve is coated with a thermally loadable lubricant layer and in which said sealing means forms a fluid seal between the cylindrical body and the apertured block with a cement layer.

3. A tuyere arrangement according to claim 1 characterised in that the cylindrical body has axially extending longitudinal ribs disposed on an outside surface of said body and peripherally distributed around said body.

4. A tuyere arrangement according to claim 1 characterised in that the outer tuyere tube, has an outer surface that is covered with a thermally loadable lubricant layer, and in that said sealing means forms a fluid seal between said outer tuyere tube and said cylindrical body.

5. A tuyere arrangement according to claim 1 characterised in that the apertured block and the cylindrical body have a radial bore disposed approximately at the middle of the axial length of the cylindrical body for receiving cement.

6. A tuyere arrangement according to claim 1 further comprising a tuyere head connected at the proximal end of said tuyere arrangement and which has a first pressure plate which locks by force one or more of said tuyere tubes within said apertured block.

7. A tuyere arrangement according to claim 6 wherein said tuyere head includes a second pressure plate that connects to a second tuyere tube and that locks by force against a first pressure plate for locking by force plural of said tuyere tubes within said apertured block.

8. A tuyere arrangement according to claim 1 characterised in that the pressure plate movably connects by guide bars which are fixed to the vessel and which extend parallel to the cylindrical body and which guide said cylindrical body axially into said apertured block.

9. A tuyere arrangement according to claim 1 characterised in that the refractory material of the apertured block and/or the cylindrical body comprises magnesite or chrome magnesite.

10. A tuyere arrangement according to claim 1 characterised in that the lubricant layer comprises a graphite paste, a molybdenum compound, soap stone or talc.

11. A tuyere arrangement according to claim 1 characterised in that the sealing means includes a cement layer comprising magnesite phosphate compound, a chrome magnesite compound or a magnesite silicon compound.

12. A method of operating a tuyere arrangement having at least two concentric metal tuyere tube according to which is fitted into the wall of a vessel accommodating a molten bath and through which agents are introduced beneath the level of the surface of the molten bath, characterised by the step of replacing, continuously or at time intervals, a consumed tuyere tip of said tuyere arrangement by axially sliding a cylindrical body of a refractory material together with the tuyere tubes through a block disposed in the vessel wall that has an aperture that extends through said tuyere arrangement and into the interior of the vessel.

13. A method according to claim 12 including the step of maintaining a preselected projection length beyond an inner end face of the apertured block by inward movement of the cylindrical body.

14. A method according to claim 12 including the step of introducing a cooling fluid through one of the tuyere tubes.

15. A method according to claim 14, including the steps of feeding atomised water one of said tubes as the cooling fluid.

16. In furnace apparatus having a vessel for containing a molten bath and having a wall connected to a tuyere arrangement for the introduction of agents into the molten bath and having a distal tip facing into the interior of said vessel and a proximal end for facing outwardly from said vessel, the tuyere arrangement comprising an apertured block of refractory material fixedly connected into said vessel wall and having an axial bore that extends through said block, a cylindrical body, adapted for axially slidably fitting with said axial bore and having an outer end projecting out of said apertured block relative to said proximal tuyere end and having a first pressure plate connected to said outer end for receiving a force that axially displaces said cylindrical body within said axial bore, and tuyere means, fitted within said cylindrical body, for introducing agents into said vessel and having an outer tuyere tube and at least one inner tuyere tube concentrically spaced from said outer tuyere tube to from a central duct and to form at least one annular duct that surrounds said central duct, and wherein said outer tuyere tube is axially slidably disposed in said cylindrical body and further including sealing means for forming a fluid seal between said outer tuyere tube and said cylindrical body, and wherein said ducts are provided with an inlet for receiving the agent to be introduced.

17. In furnace apparatus according to claim 16, wherein said wall connected to said tuyere arrangement comprises a sidewall of said furnace.

18. Furnace apparatus according to claim 16, wherein said wall connected to said tuyere arrangement comprises a bottomwall of said furnace.

* * * * *